US005191839A

United States Patent [19]

Young et al.

[11] Patent Number: 5,191,839

[45] Date of Patent: Mar. 9, 1993

[54] RAIL HANDLING APPARATUS

[75] Inventors: Hartley F. Young, West Melton; Josef Nevidal, Wynn Vale, both of Australia

[73] Assignee: Pandrol Canada Limited, Montreal, Canada

[21] Appl. No.: 827,157

[22] Filed: Jan. 28, 1992

[30] Foreign Application Priority Data

Jan. 31, 1991 [AU] Australia ..... PK4386

[51] Int. Cl.[5] ..... B61H 13/00

[52] U.S. Cl. ..... 104/2; 104/17.2

[58] Field of Search ..... 104/17.2, 307, 2, 16, 104/8, 4, 5; 238/310, 349, 351

[56] References Cited

U.S. PATENT DOCUMENTS

| | | | |
|---|---|---|---|
| 3,134,339 | 5/1964 | Plasser et al. | 104/8 |
| 3,952,665 | 4/1976 | Stewart et al. | 104/8 |
| 4,068,593 | 1/1978 | Leeves | 104/17.2 |
| 4,379,521 | 4/1983 | Young et al. | 238/310 |
| 5,003,888 | 4/1991 | Martin | 104/17.2 |
| 5,074,219 | 12/1991 | Theurer et al. | 104/17.2 |

FOREIGN PATENT DOCUMENTS

| | | | |
|---|---|---|---|
| 531168 | 11/1979 | Australia . | |
| 532320 | 7/1980 | Australia . | |
| 548030 | 9/1981 | Australia . | |
| 555696 | 6/1983 | Australia . | |
| 2820804 | 11/1979 | Fed. Rep. of Germany | 104/307 |
| 2031486 | 4/1980 | United Kingdom | 104/17.2 |
| 2102863 | 2/1983 | United Kingdom | 104/17.2 |

*Primary Examiner*—Mark T. Le

*Attorney, Agent, or Firm*—Norbert P. Holler

[57] ABSTRACT

Insulators which lie between the rail and elastic rail fasteners are correctly positioned on either side of the rail by manipulating the rail by the application of a pulsed force to either side of the rail. A pair of hydraulic rams 19, 20 driven by the same pressure pump are used to drive two pulse heads 9, 10 via pivoted linkages to abut either side of the web 3 of a rail 1. The pulsating operation is carried out prior to the operation of the clip fitting machine to ensure that the rail insulators are in the correct initial position prior to being driven on to the rail flange.

2 Claims, 3 Drawing Sheets

RAIL HANDLING APPARATUS

Figure 1:
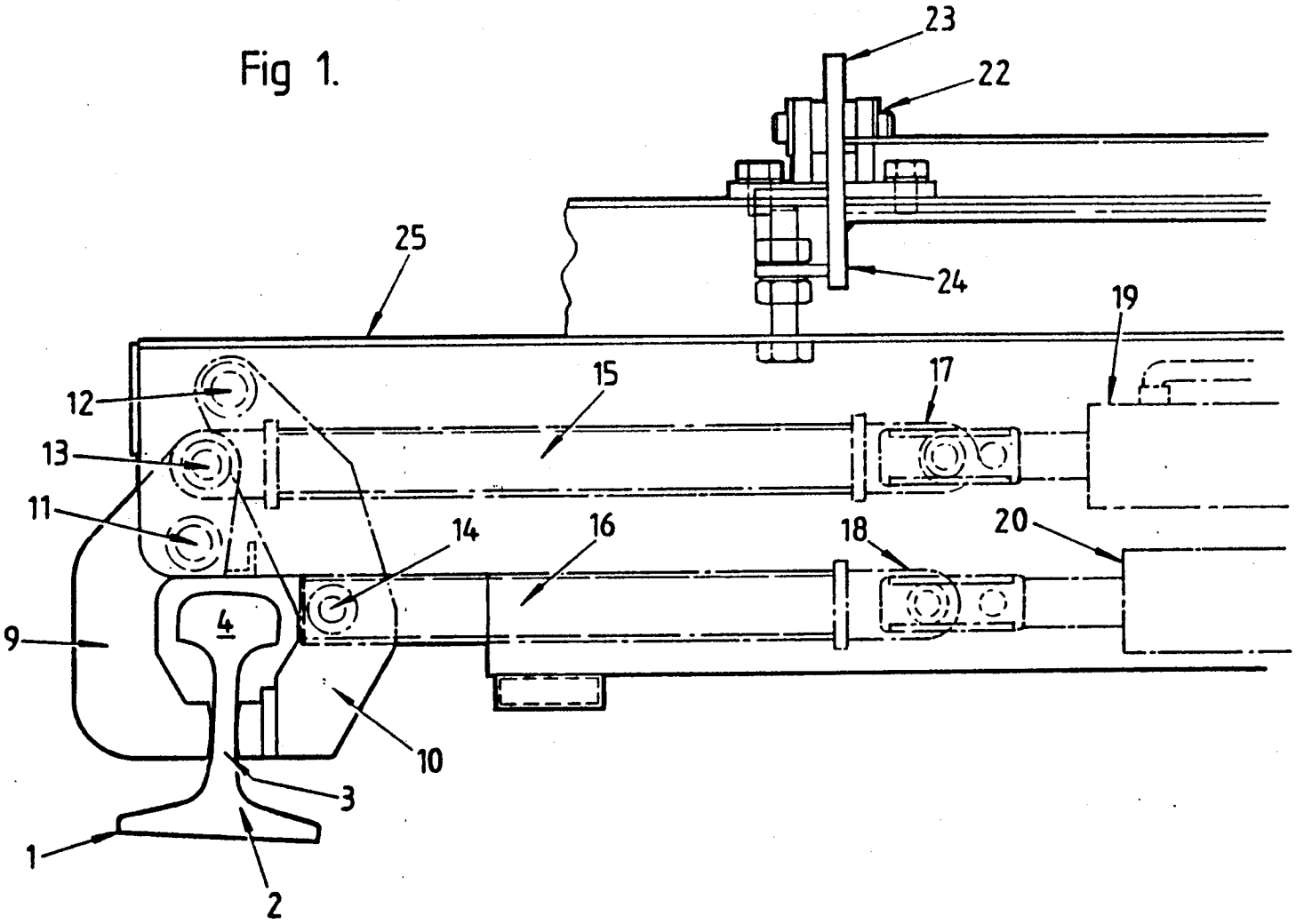

This invention relates to means for improving the method of laying rails and installing rail fasteners to the rail.

In particular this invention is concerned with installing rail insulators which lie between the rail flange and the rail fasteners and the fastener shoulders which are embedded in the rail tie.

When a rail is installed on concrete ties it is not possible to maintain it in an exactly central position in the rail seat before the insulators are installed. This is due to the lateral tolerance in the initial tie placement, which of course results in slight misalignment of the ties, plus the difficulty in threading the rail exactly into the centre of the rail seat. In addition, before the rail is clipped down, it frequently tends to spring sidewards due to track curvature or rail thermal stresses.

When a rail is installed, all of the foregoing factors usually cause the rail to be initially sitting hard against one shoulder, thus making it a slow and difficult process to install the insulators because it is often necessary to centralize the rail in every rail seat first, the entire procedure thus being highly labour intensive and a costly operation.

Australian Patent specification 555696 discloses a method and apparatus for positioning such an insulator. Other magazine delivery systems are also used in placing insulators on either side of a rail in the rail seat. However a long standing difficulty exists because the rail rarely lies midway between the two fastener shoulders on the rail tie. This results in one of the insulators being incorrectly positioned because the rail is too close to the shoulder for the dependent portion of the insulator to lie between the rail flange and the shoulder. In order to fit these insulators the rail needs to be manipulated so that the gap between the rail and the shoulder is widened to accommodate the insulator.

Australian Patent 531168 discloses apparatus for manipulating rails vertically or sideways which includes means to grip the edges of the two rail flanges of a rail. This apparatus adjusts the position of the rail and holds it in that position to allow the insulators to be placed in position and for the rail fasteners to be applied.

It is an object of this invention to provide a simple means for manipulating rails to enable insulators to be correctly positioned.

to this end the present invention provides a method of fastening rails in which the insulators are placed in an approximate correct position. The rail is subjected to a pulsing force to enable the rail to shift sufficiently for the insulators to fall into the correct position and subsequently applying the fasteners.

The apparatus which is also part of this invention comprises a pair of abutment means adapted to abut each side of the rail and pulsating means to alternately move each abutment means into engagement with the rail to move the rail sufficiently to enable an insulator to fit into place.

Preferably this invention is used to install insulators of the kind described in U.S. Pat. No. 4,463,898 (AU 532320) although it is equally applicable to all types of insulators which fit between the rail, the rail fastener and the shoulder.

It is also preferred that this invention is used as an adjunct to the rail fastening attachment machine described in U.S. Pat. No. 4,494,463 (AU 548030). The apparatus of this invention is able to be fitted as an attachment to the rail clip fitting machine of U.S. Pat. No. 4,494,463 so that the rail can be manipulated to allow the insulators to be positioned correctly prior to application of the rail clips.

In the present invention sustained application of force to move the rail is not needed as a pulse is sufficient to displace the rail for a time sufficient to allow the insulator to fall into its correct place.

The pulsing action is preferably applied to both sides of the rail. This pulsing action is applied automatically and rhythmically to provide sufficient rail movement to achieve settling of the insulators. The pulsing force is preferably applied to a section of the rail that has not been completely secured in place.

A preferred embodiment of this invention will now be described.

The rail seat into which the insulators are to be placed and the insulators themselves are of the type disclosed in U.S. Pat. No. 4,463,898. The apparatus is attached to the machine of the type disclosed in U.S. Pat. No. 4,494,463.

In the drawings

Figure 2:
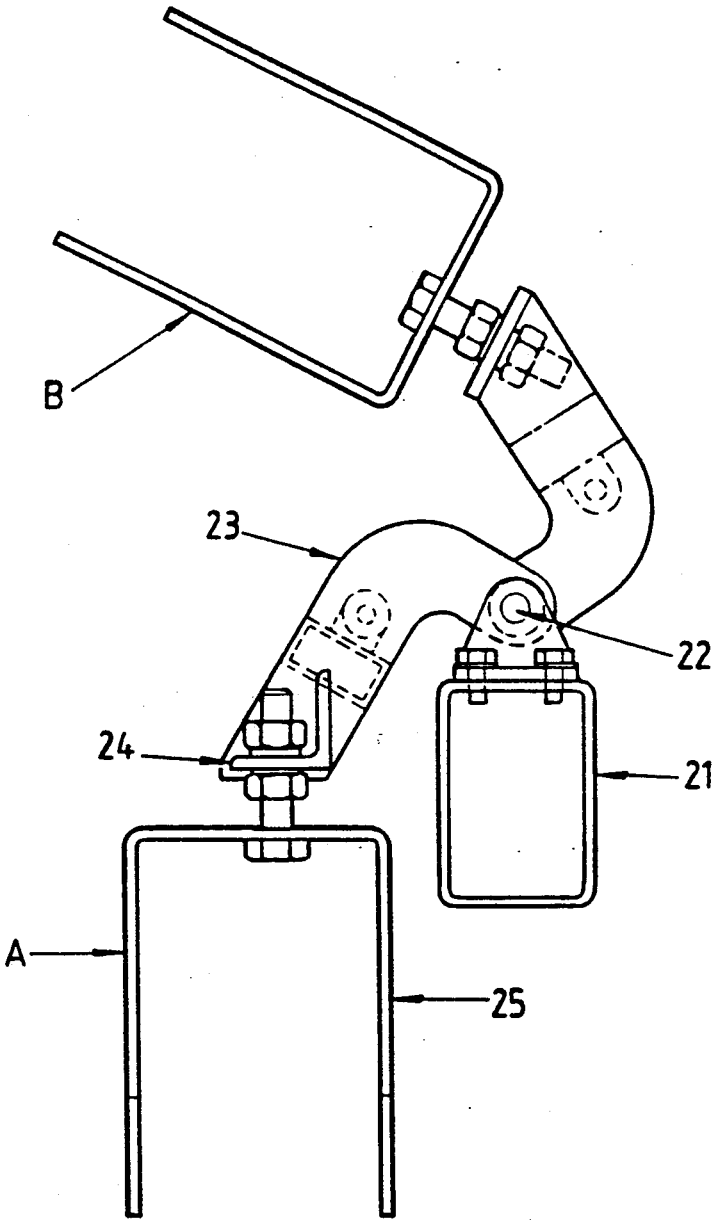

FIG. 1 discloses a cross-sectional view of the apparatus positioned over a rail and FIG. 2 is an end view showing the means of attaching the apparatus to the rail clip fitting machine.

Figure 3:
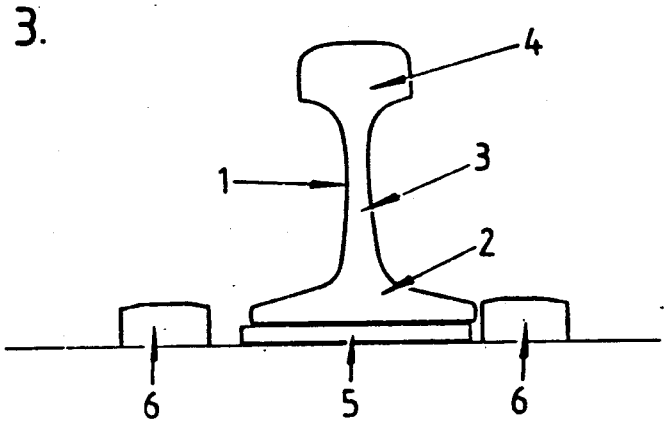
Figure 4:
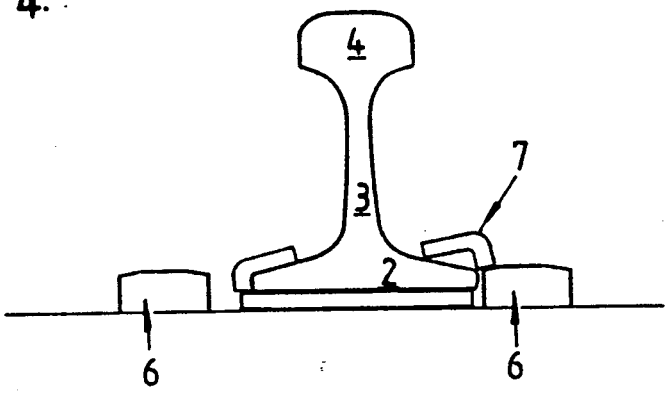
Figure 5:
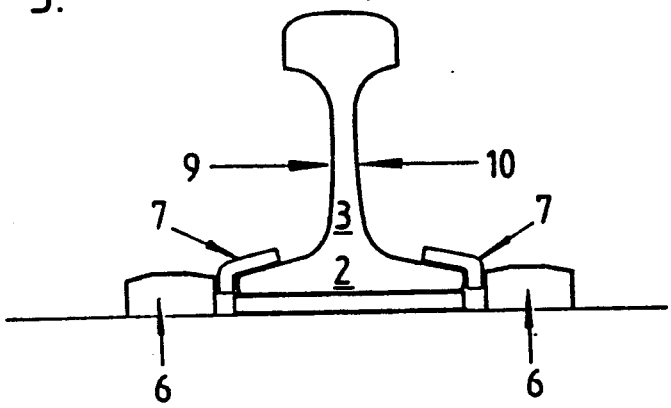

FIGS. 3, 4 and 5 illustrate the method of using the apparatus of FIGS. 1 and 2.

In FIG. 1 the rail 1 comprises the flange 2, web 3 and head 4. The manipulator apparatus comprises a body section 25 which supports two pulse heads 9 and 10 which abut each face of the rail web 3.

The pulse head 9 abuts the face of the web 3 remote from the clip fitting machine and comprises a hooked member pivotted for angular movement about pin 11 and connected to a reciprocating rod 15 at pivot pin 13. The rod 15 is driven by a hydraulic ram 19 through a roller guide head 17.

Similarly the pulse head 10 is pivotted for movement to abut the near face of web 3 about a pin 12. Intermediate the abutting head 10 and the pivot 12 is the pivot point 14 at which the reciprocating rod 16 is joined to the pulse head 10. The rod 16 is driven by an hydraulic ram 20 through a roller guide head 18.

The hydraulic rams 19 and 20 are driven by the same pressure pump through a valve arrangement which means that one ram is extending as the other contracts.

The body 25 is connected to a chassis member 21 of the clip fitting machine via a linkage comprising a v web member 23 and the pivot pin 22 and the fastening 24. In FIG. 2 position A shows the working position of the apparatus 25 and position B is the folded position when the apparatus is not in use. The pulsing head is positioned on the front of the clip fitting machine—some distance ahead of the clip fitting head.

The method of using the apparatus is illustrated in FIGS. 3, 4 and 5 in which the rail 1 sits on a rail pad 5 which in turn lies on the rail tie. The rail fastener support shoulders 6 lie on either side of the rail 1 and the insulators 7 have a portion which lies on the rail flange 3 and a dependent portion which lies between the shoulder 6 and the rail flange 3.

In FIG. 3 the rail 1 is shown in a typical position prior to fastening with the rail lying too close to one of the shoulders 6. After the insulators 7 are placed into approximate alignment one of them sits correctly but the other cannot fit between the rail flange 3 and the shoulder 6 as shown in FIG. 4.

When the operator of the clip fitting machine moving along the rails brings the machine to a halt to begin pressing clips into position, the pulsing head is actuated to automatically pulse the rail ahead of where the clips are being fitted, so that the insulators drop into place and are ready for clip installation when the machine moves forward to the next rail seat on the next rail tie.

A pulsing force from the pulse heads 9 or 10 will displace the rail. In the case where FIGS. 3, 4 and 5 show the rail of FIG. 1, a pulse from the head 10 driven from ram 20 will push the rail away from the shoulder 6 to allow the insulator 7 on the near side to drop into position as shown in FIG. 5.

When the machine operator engages the unit to travel forward along the rail to the next rail tie, the pulsing heads 9 and 10 are automatically retracted away from the rail to permit free forward movement of the machine.

From the above it can be seen. that this invention provides a much simpler means of fitting insulators that requires less energy application than prior proposals.

We claim:

1. A method of fitting rail insulators into proper positions at the foot of a railway rail having a foot-constituting bottom flange located between two rail fastener supporting shoulders, each of said insulators when in use having a portion located between the rail bottom flange and one of said shoulders and another portion overlying a proximate part of said bottom flange, said rail further having a head and a vertical web between said head and said bottom flange, comprising the steps of:

(a) prior to attaching railway clips to said fastener supporting shoulders, placing said rail insulators approximately at said proper positions; and (b) applying a pulsating force alternately to the opposite sides of said rail web for moving the rail sufficiently relative to said fastener supporting shoulders to enable at least one of said insulators to be displaced into said proper position.

2. A method as claimed in claim 1, wherein said pulsating force is applied to said rail web at a section of the rail which has not been completely secured into place by railway clips.

* * * * *